US008635719B2

(12) United States Patent
Homami et al.

(10) Patent No.: US 8,635,719 B2
(45) Date of Patent: Jan. 28, 2014

(54) ADJUSTABLE OVERFLOW CLOSURE DEVICE

(76) Inventors: Max Homami, Los Angeles, CA (US); Michael Gerard Rohlfs, Los Angeles, CA (US)

( * ) Notice: Subject to any disclaimer, the term of this patent is extended or adjusted under 35 U.S.C. 154(b) by 0 days.

(21) Appl. No.: 13/563,666

(22) Filed: Jul. 31, 2012

(65) Prior Publication Data

US 2013/0031720 A1 Feb. 7, 2013

Related U.S. Application Data

(60) Provisional application No. 61/514,340, filed on Aug. 2, 2011.

(51) Int. Cl.
*F16K 35/14* (2006.01)
*F16K 11/074* (2006.01)

(52) U.S. Cl.
USPC ..... 4/694; 137/625.46

(58) Field of Classification Search
USPC ..... 4/694, 668, 685, 674, 679, 690, 255.01; 137/625.46
See application file for complete search history.

(56) References Cited

U.S. PATENT DOCUMENTS 1,281,222 A * 10/1918 Stepanchak ..... 4/694
3,559,634 A * 2/1971 Lillywhite ..... 601/157
3,570,020 A * 3/1971 Kato ..... 4/694
3,835,484 A * 9/1974 Kato ..... 4/694
3,927,428 A 12/1975 Jette et al.
4,042,984 A 8/1977 Butler
4,524,798 A 6/1985 Simard
4,607,658 A 8/1986 Fraser et al.
4,744,108 A 5/1988 Schmidt
5,123,123 A 6/1992 Hart et al.
5,190,077 A * 3/1993 Pawelzik et al. ..... 137/625.46
6,216,288 B1 4/2001 Bernau
6,732,388 B2 5/2004 McKenna
6,895,610 B2 5/2005 Olson
7,451,502 B2 11/2008 Ball

* cited by examiner

*Primary Examiner* — Gregory Huson
*Assistant Examiner* — Christine Skubinna
(74) *Attorney, Agent, or Firm* — Martino Patent Law

(57) ABSTRACT

A three-position, circularly-shaped, height-adjustable overflow drain is disclosed. A circular back plate includes a bottom half opposite a top half, and is configured to be attachable to an overflow elbow. A first aperture is located in the bottom half of the back plate. A second aperture is located in the top half of the back plate. A rotatable handle comprises an outer cylindrical portion including a center plate. A third aperture is located in the center plate. The first, second and third apertures are aligned along a common radius, wherein the rotatable handle is rotatable to align either the first and third apertures, the second and third apertures, or no apertures. A cover plate is disposed within the rotatable handle and attached to the circular back plate forming an annular gap between the cover plate and the outer cylindrical portion.

11 Claims, 4 Drawing Sheets

ADJUSTABLE OVERFLOW CLOSURE DEVICE

CROSS-REFERENCE TO RELATED APPLICATIONS

This non-provisional application claims priority to provisional application 61/514,340 filed on Aug. 2, 2011 entitled PARTIAL AND COMPLETE OVERFLOW CLOSURE DEVICE by inventors Max Homami and Michael Rohlfs, the contents of which are fully incorporated herein.

DESCRIPTION

1. Field of the Invention

The present invention generally relates to overflow closure devices and overflow drains. More particularly, the present invention relates to an adjustable overflow drain that can vary the water level within a tub or sink.

2. Background of the Invention

A typical bathtub has a lower drain at the lowest part of the tub and an upper overflow drain mounted on a side wall near the front of the tub. The lower drain is typically used to control the amount of water located within the tub. When the lower drain is open, water can quickly exit out the lower drain. The overflow drain facilitates the water quickly leaving through the lower drain by allowing air to vent through.

When the lower drain is closed, water fills within the tub. If one was to leave the water on, the water would fill the tub and overflow the tub. To prevent this, the typical overflow drain has an opening which allows water to escape through the drainage/plumbing.

The typical overflow device is generally circular and has a water opening located at its lower most portion. A problem arises when a person wants to use the tub and allow water to fill within. It is very common for the overflow drain to prevent the water level rising to a sufficient level to make the bathing experience enjoyable. The overflow drain decreases the height of water available in the bath tub or sink. As many common tubs are as little as fourteen inches high, the amount of usable water in the tub can be as little as seven inches due to the overflow drain.

Others have attempted to solve this problem by creating plugs that can be inserted into existing overflow drains. These plugs are cumbersome, are easily lost or fall out from within the overflow drain making loud noises and risk being stepped on by the user. Also, they prevent air from escaping through the overflow device when draining a tub or sink.

Others have attempted to create cumbersome and complicated devices that allow one to control the level of water with floats, automatic switches and electronics. However, these devices are not easily incorporated into existing tub designs and are impractical for normal usage.

Others have attempted to attach snorkels to the overflow drains. The snorkels may be positioned to control the height of the water within the tub. However, these snorkels are odd in appearance and detract from the aesthetics of the tub's appearance. Also, the snorkels cannot completely seal the overflow drain completely allowing water to rise well above the snorkel.

Accordingly, there is a need for a novel adjustable overflow closure device that allows one to vary the height of the water level and even to seal the overflow completely while remaining aesthetically pleasing and functionally easy to use. The present invention fulfills these needs and provides other related advantages.

SUMMARY OF THE INVENTION

An exemplary embodiment of the present invention discloses a three-position, circularly-shaped, height-adjustable overflow drain. A circular back plate is defined as comprising a bottom half opposite a top half, wherein the back plate is configured to be attachable to an overflow elbow. A first aperture is located in the bottom half of the back plate. A second aperture is located in the top half of the back plate. A rotatable handle comprises an outer cylindrical portion including a center plate disposed inside the outer cylindrical portion. A third aperture is located in the center plate. The first, second and third apertures are aligned along a common radius, wherein the rotatable handle is rotatable to align either the first and third apertures, the second and third apertures, or no apertures. A cover plate is disposed within the rotatable handle and attached to the circular back plate forming an annular gap between the cover plate and the outer cylindrical portion. A first, second and third marking is disposed on and near an edge of the cover plate, each marking located 120 degrees relative to another marking. The first marking is associated with the first aperture, the second marking is associated with the second aperture, and the third marking is associated with no apertures. A fourth marking is disposed on the outer cylindrical portion radially aligned with the third aperture, where the fourth marking may be rotated to align with either the first, second, or third markings.

Other exemplary embodiments may include at least one flexural stop disposed on an outside circumference of the back plate. At least one notch may be disposed on an inside of the outer cylindrical portion of the rotatable handle. The at least one flexural stop may be configured to engage the at least one notch providing a tactile feedback to a user when rotating the rotatable handle.

The first, second and third apertures are disposed within the outer cylindrical portion behind the cover plate, such that the aesthetic appearance of the overflow drain is maintained.

In another exemplary embodiment of the present invention an overflow drain includes a circular back plate defined as comprising a bottom half opposite a top half. The back plate is configured to be attachable to an overflow elbow. A first aperture is located in the bottom half of the back plate. A second aperture is located in the top half of the back plate. A rotatable handle includes an outer cylindrical portion including a center plate disposed inside the outer cylindrical portion. A third aperture is located in the center plate. The first, second and third apertures are aligned along a common radius where the rotatable handle is rotatable to align either the first and third apertures, the second and third apertures, or no apertures.

Other exemplary embodiments may include a cover plate disposed within the rotatable handle and attached to the circular back plate forming an annular gap between the cover plate and the outer cylindrical portion.

A first, second and third marking may be disposed on and near an edge of the cover plate, each marking located 120 degrees relative to another marking. A fourth marking may be disposed on the outer cylindrical portion radially aligned with the third aperture, where the fourth marking may be rotated to align with either the first, second, or third markings.

At least one flexural stop may be disposed on an outside circumference of the circular back plate. At least one notch may be disposed on an inside of the outer cylindrical portion of the rotatable handle. The at least one flexural stop may be configured to engage the at least one notch providing a tactile feedback to a user when rotating the rotatable handle.

The first, second and third apertures may be disposed within the cylindrical portion. A foam backing may be adhered to the circular back plate.

An overflow elbow may be attached to the circular back plate with a fastener, where the fastener biases the circular back plate towards the overflow elbow, such that a tub opening is captured between the back plate and the overflow elbow.

In another exemplary embodiment of the present invention a water-level adjustable overflow drain includes an outer dial cylindrical in shape comprising a circular center plate disposed inside the outer dial and comprising an overflow aperture in the circular center plate. A circular back plate comprises a lower and upper aperture, where the circular back plate is configured to be attachable to a tub or sink. The circular center plate is sealed and rotatable relative to the circular back plate, where the overflow aperture can be rotated to align with either the lower aperture, the upper aperture or neither aperture.

Other exemplary embodiments may include a circular cover plate disposed within the outer dial and attached to the circular back plate forming an annular gap between the circular cover plate and the outer dial.

A first, second and third marking may be disposed on and near an edge of the circular cover plate, each marking located 120 degrees relative to another marking. A fourth marking may be disposed on the outer dial radially aligned with the overflow aperture, where the fourth marking may be rotated to align with either the first, second, or third markings.

At least one flexural stop may be disposed on an outside circumference of the circular back plate and including at least one notch disposed on an inside of the outer dial, wherein the at least one flexural stop is configured to engage the at least one notch providing a tactile feedback to a user when rotating the rotatable handle.

An overflow elbow may be attached to the circular back plate with a fastener, where the fastener biases the circular back plate towards the overflow elbow, such that a tub or sink opening is captured between the circular back plate and the overflow elbow.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
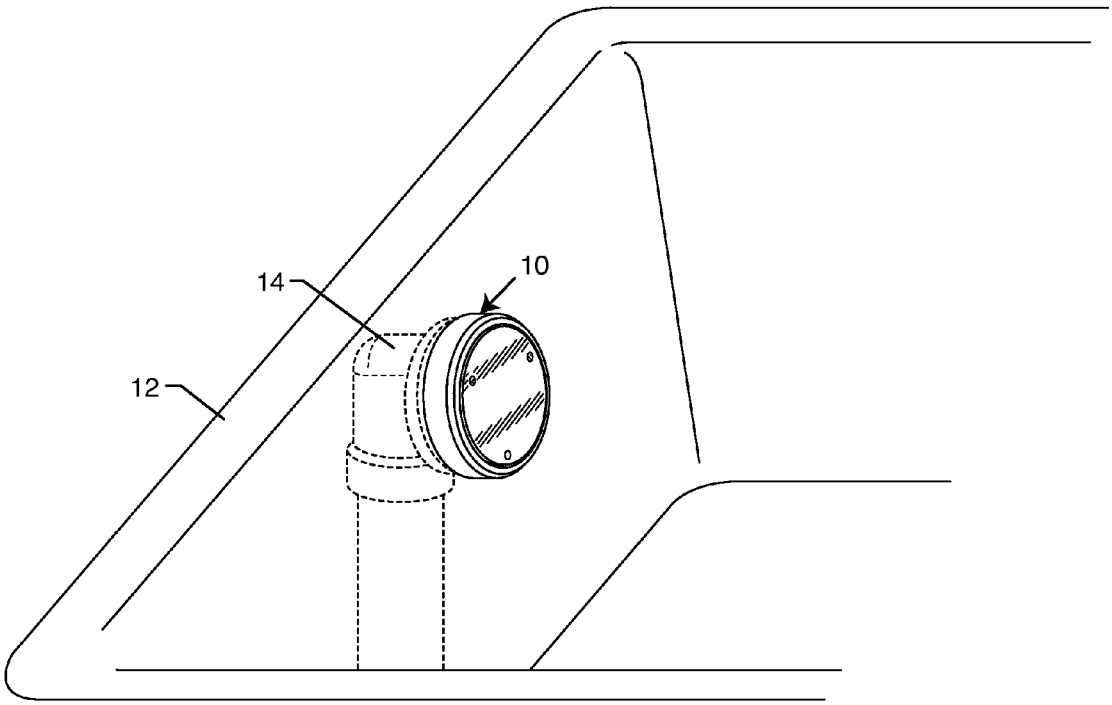
FIG. 1 is a perspective view of an exemplary adjustable overflow closure device of the present invention.

FIG. 1 is a perspective view of an exemplary adjustable overflow closure device or overflow drain 10 of the present invention. The overflow drain 10 is mounted to a tub 12. The overflow elbow 14 is shown in dashed lines on the backside of the tub 12.

Figure 2:
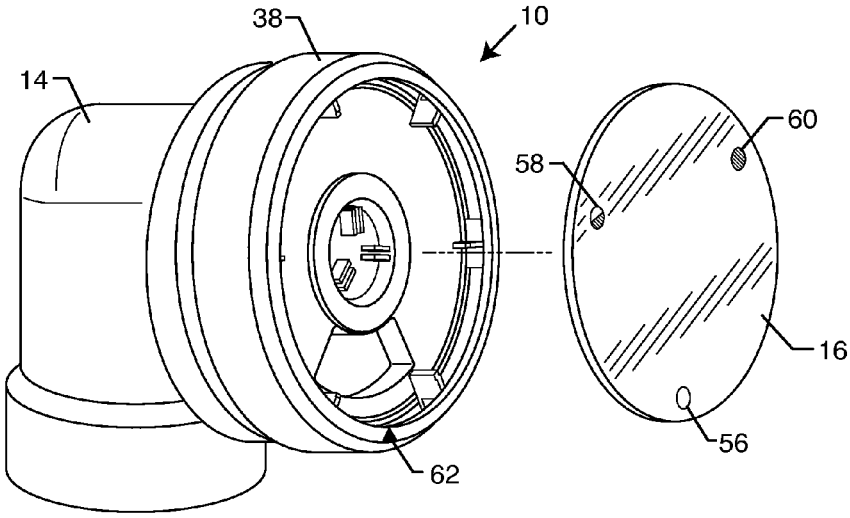
FIG. 2 is an enlarged perspective view of the adjustable overflow closure device of FIG. 1 now with the cover plate removed.
Figure 3:
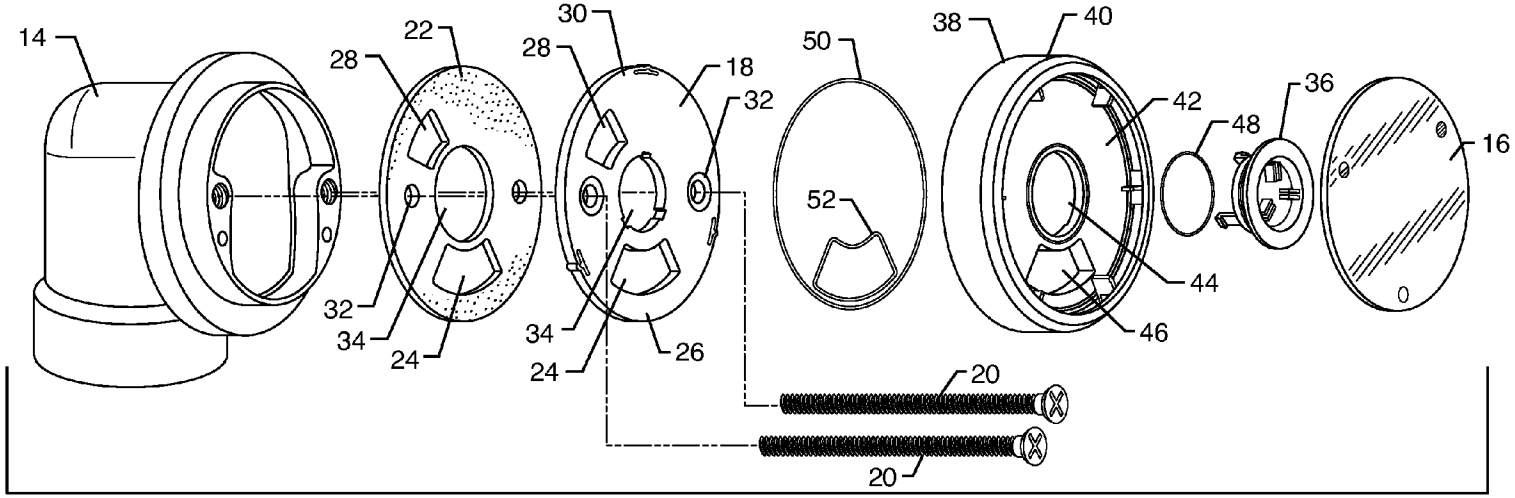
FIG. 3 is an exploded and front perspective view of the structure of FIGS. 1 and 2.
Figure 4:
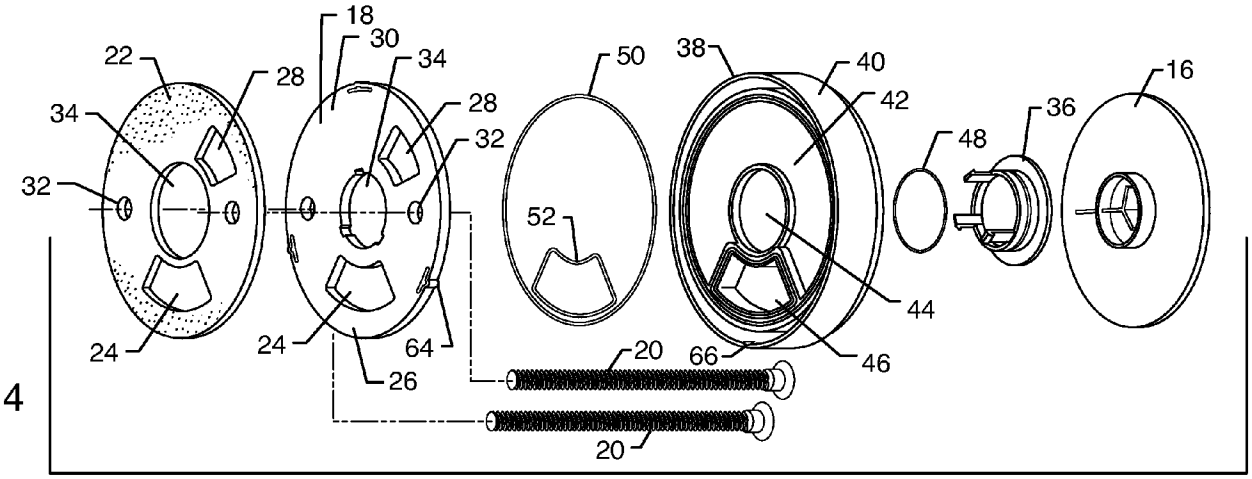
FIG. 4 is an exploded and rear perspective view of the structure of FIG. 3.
Figure 5:
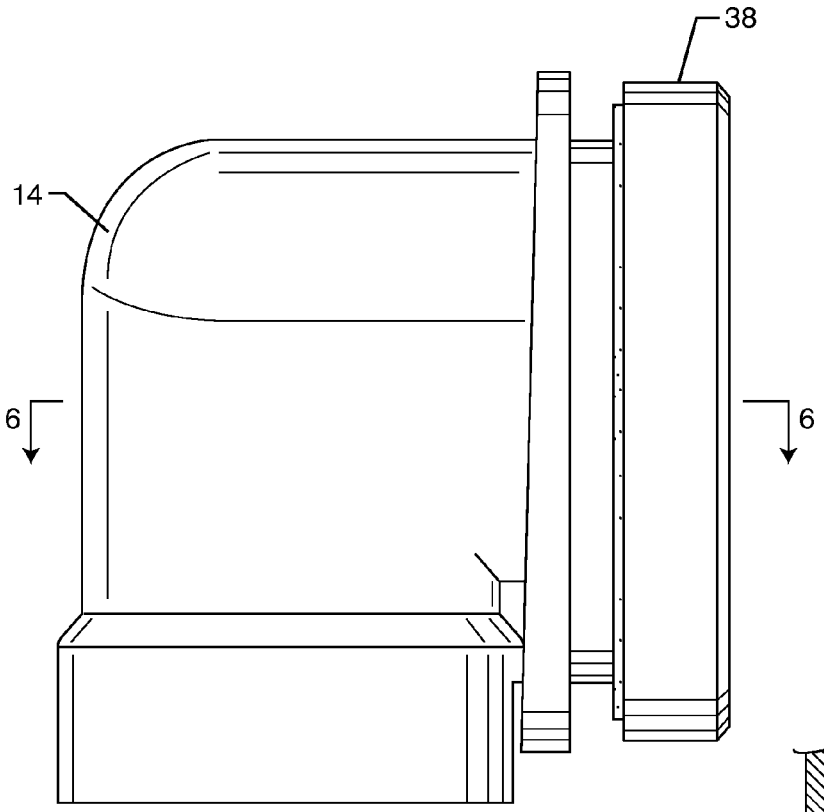
FIG. 5 is a side view of the structure of FIG. 2.
Figure 6:
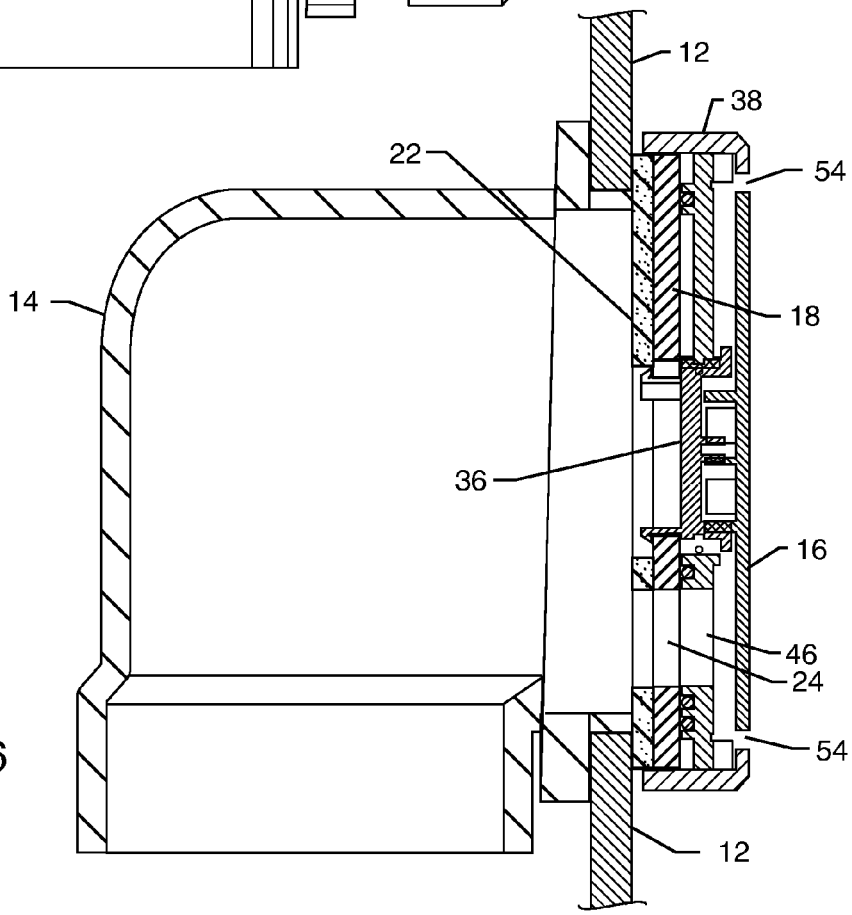
FIG. 6 is a sectional view of the structure of FIG. 5.

FIG. 2 is an enlarged perspective view of the adjustable overflow closure device 10 of FIG. 1 now with the cover plate 16 removed. FIG. 3 is an exploded and front perspective view of the structure of FIGS. 1 and 2. FIG. 4 is an exploded and rear perspective view of the structure of FIG. 3. FIG. 5 is a side view of the structure of FIG. 2. FIG. 6 is a sectional view of the structure of FIG. 5.

Now referring to FIGS. 1-6, the back plate 18 can be attached to the overflow elbow 14 through fasteners 20. The back plate 18 and overflow elbow 14 capture the tub 12 in between. The overflow device 10 is secured by the fasteners 20 or similar means of gripping and creating a bias between the back plate 18 and the overflow elbow 14. Therefore, the back plate 18 is secured relative to the tub 12 and does not move or rotate.

A foam or rubber backing 22 is adhered to the back plate 18. The foam backing 22 has the exact size and shape of the back plate 18. The foam backing 18 helps to create a deformable surface that abuts the inside of the tub 12. The foam backing 22 prevents scratches or marks being imparted onto the inside surface of the tub 12. The foam backing 22 also helps to create a solid connection between the tub 12 and the closure device 10.

Both the back plate 18 and the foam backing 22 have two radially disposed apertures. A lower aperture 24 is located in the bottom half 26 of the back plate 18. An upper aperture 28 is located in the top half 30 of the back plate 18. The lower aperture 24 and upper aperture 28 allow water from the tub 12 to pass through to the plumbing connected to the overflow elbow 14, as will be later discussed.

The back plate 18 and foam backing 22 also have two holes 32 for the fasteners 20. The back plate 18 and the foam backing 22 also each have a center hole 34. The center hole 34 could be eliminated in various embodiments, as the center hole 34 is utilized as an attachment location for the center plug 36.

The center plug 36 snaps into place by engaging the center hole 34 of the back plate 18. Alternatively, the center plug 36 could have been bonded or fastened to the back plate 18 with a fastener.

The cover plate 16 then is removably attachable to the center plug 36. The cover plate 16 is designed to engage the center plug 36 and remain stationary and fixed relative to the tub 12. The center plug 36 also engages the rotatable handle/dial 38.

The handle 38 has an outer cylindrical portion 40 including a center plate 42. The outer cylindrical portion 40 can be formed separate from the center plate 42, or both formed as one part. The center plate 42 has a center hole 44 that allows the center plug 36 to penetrate through. The handle 38 is then able to rotate relative to the back plate 18. This means that the back plate 18 stays stationary while the center plate 42 rotates.

The center plate 42 includes an aperture 46. Aperture 46 is able to rotate as the center plate 42 rotates. This means that the aperture 46 can then be aligned with either the lower aperture 24, the upper aperture 28, or neither of the apertures 24 or 28.

All of the apertures 24, 28 and 46 are aligned along a common radius such that they can align when properly rotated. It is also worth noting that the lower aperture 24 and upper aperture 28 are generally spaced about 120 degrees apart. This then means that there is also a portion of the back plate 18 that is another 120 degrees apart from apertures 24 and 28 where it is a solid portion of material that is void of apertures. When the aperture 46 of the center plate 42 is aligned with neither aperture 24 or 28, the tub 12 is able to be filled to the top which can be above the overflow closure device 10.

Various seals prevent water from leaking through undesired locations. Seals/o-rings 48, 50 and 52 prevent water seepage past any location other than the lower aperture 24 and upper aperture 28.

The cover plate 16 does not touch the outer cylindrical portion 40 of the handle/dial 38. An annular gap 54 resides between the cover plate 16 and the outer cylindrical portion 40 that allows water to flow through. Water is then able to pass through the annular gap 54, through the aperture 46 and then through either the upper aperture 28 or lower aperture 24.

The cover plate 16 has several markings located near the circumferential edge. A first marking 56, second marking 58 and third marking 60 are aligned with the apertures. For instance, the first marking 56 is aligned with the lower aperture 24. The second marking 58 is aligned with the upper aperture 28. The third marking 60 is aligned with no apertures.

The rotatable handle/dial 38 also has a fourth marking 62. The fourth marking 62 is aligned with the aperture 46 in the center plate 42. When the fourth marking 62 matches up/aligns with the other markings, different functions are possible by the overflow closure device 10.

Figure 7:
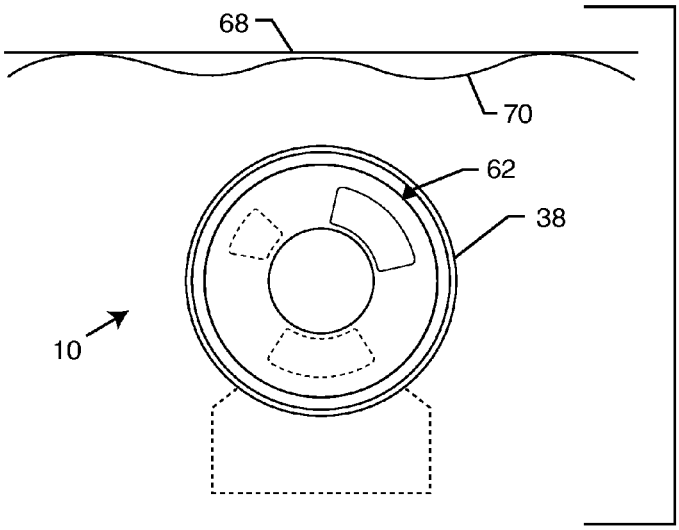
FIG. 7 is a front view showing the structure of FIGS. 1-6 in the closed position.

FIG. 7 is a front view showing the structure of FIGS. 1-6 in the closed position. FIG. 7 represents when the fourth marking 62 is aligned with the third marking 60. This means the aperture 46 is not in alignment with either the lower aperture 24 or the upper aperture 28. The tub 12 is then able to fill beyond the overflow drain 10. The water level 68 and water 70 are shown above the overflow drain 10.

Figure 8:
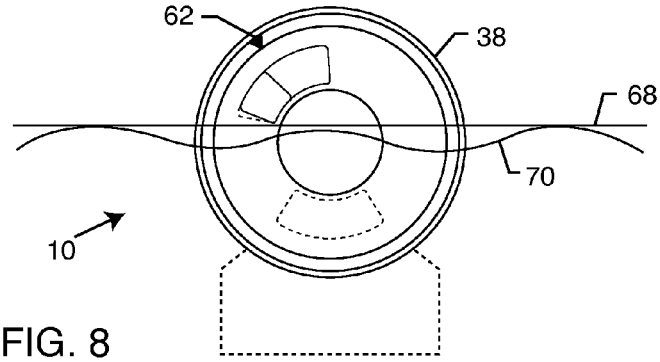
FIG. 8 is a front view showing the structure of FIGS. 1-6 in the upper drainage position.

FIG. 8 is a front view showing the structure of FIGS. 1-6 in the upper drainage position. FIG. 8 represents when the fourth marking 62 is aligned with the second marking 58. This means the aperture 46 is aligned with the upper aperture 28. The tub 12 is then able to fill up to the level of the upper aperture 28.

Figure 9:
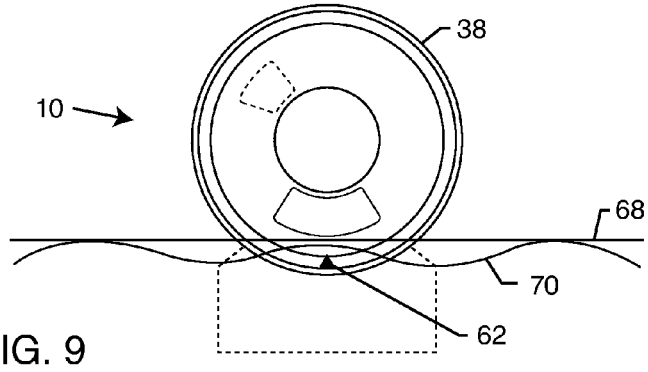
FIG. 9 is a front view showing the structure of FIGS. 1-6 in the lower drainage position.

FIG. 9 is a front view showing the structure of FIGS. 1-6 in the lower drainage position. FIG. 9 represents when the fourth marking 62 is aligned with the first marking 56. This means the aperture 46 is aligned with the lower aperture 24. The tub 12 is then able to fill up to the level of the lower aperture 24. While the water level difference between the upper aperture 28 and lower aperture 24 may not seem like a lot, this extra inch and a half of water level can make all the difference between a frustrating bathing experience and an enjoyable one.

Another novel feature of the present invention is the built in stop that helps a user select the different positions. Three flexural stops 64 are molded into the back plate 18. The flexural stops 64 engage a notch 66 disposed on the inside surface of the outer cylindrical portion 40. When the flexural stops 64 engage the notch 66, it provides a tactile feedback to a user when rotating the rotatable handle 38. Other means and methods of creating tactile feedback and stops can be devised by those skilled in the art and this disclosure is not intended to be limited to the precise form shown and described herein.

Although several embodiments have been described in detail for purposes of illustration, various modifications may be made to each without departing from the scope and spirit of the invention. Accordingly, the invention is not to be limited, except as by the appended claims.

What is claimed is:

1. An overflow drain, comprising:

a back plate defined as comprising a bottom half opposite a top half, wherein the back plate is configured to be attachable to an overflow elbow;

a first aperture located in the bottom half of the back plate;

a second aperture located in the top half of the back plate;

a rotatable handle comprising an outer portion including a center plate disposed inside the outer portion;

a third aperture located in the center plate;

wherein the first, second and third apertures are aligned along a common radius where the rotatable handle is rotatable to align either the first and third apertures, the second and third apertures, or no apertures; and at least one flexural stop disposed on an outside circumference of the back plate and at least one notch disposed on an inside of the outer portion of the rotatable handle wherein the at least one flexural stop is configured to engage the at least one notch providing a tactile feedback to a user when rotating the rotatable handle.

2. The overflow drain of claim 1, including a cover plate disposed within the rotatable handle and attached to the back plate forming an annular gap between the cover plate and the outer portion.

3. The overflow drain of claim 2, including a first, second and third marking disposed on and near an edge of the cover plate, each marking located 120 degrees relative to another marking.

4. The overflow drain of claim 3, including a fourth marking disposed on the outer portion radially aligned with the third aperture, where the fourth marking may be rotated to align with either the first, second, or third markings.

5. The overflow drain of claim 1, wherein the first, second and third apertures are disposed within the outer portion.

6. The overflow drain of claim 1, including a foam backing adhered to the back plate.

7. The overflow drain of claim 1, including an overflow elbow attached to the back plate with a fastener, where the fastener biases the back plate towards the overflow elbow, such that a tub opening is captured between the back plate and the overflow elbow.

8. A water-level adjustable overflow drain, comprising:

an outer dial cylindrical in shape comprising a circular center plate disposed inside the outer dial and comprising an overflow aperture in the circular center plate;

a circular back plate comprising a lower and upper aperture, the circular back plate configured to be attachable to a tub or sink;

wherein the circular center plate is sealed and rotatable relative to the circular back plate, where the overflow aperture can be rotated to align with either the lower aperture, the upper aperture or neither aperture; and a stationary circular cover plate disposed within the outer dial and attached to the circular back plate forming an annular gap between the circular cover plate and the outer dial.

9. The overflow drain of claim 8, including a first, second and third marking disposed on and near an edge of the circular cover plate, each marking located 120 degrees relative to another marking and including a fourth marking disposed on the outer dial radially aligned with the overflow aperture, where the fourth marking may be rotated to align with either the first, second, or third markings.

10. The overflow drain of claim 8, including at least one flexural stop disposed on an outside circumference of the circular back plate and including at least one notch disposed on an inside of the outer dial, wherein the at least one flexural stop is configured to engage the at least one notch providing a tactile feedback to a user when rotating the rotatable handle.

11. The overflow drain of claim 8, including an overflow elbow attached to the circular back plate with a fastener, where the fastener biases the circular back plate towards the overflow elbow, such that a tub or sink opening is captured between the circular back plate and the overflow elbow.

* * * * *